US009902050B2

(12) United States Patent
Tsai

(10) Patent No.: US 9,902,050 B2
(45) Date of Patent: Feb. 27, 2018

(54) MAGNETIC POSITIONING DEVICE FOR HAND TOOL

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 142 days.

(21) Appl. No.: 15/081,939

(22) Filed: Mar. 28, 2016

(65) Prior Publication Data

US 2017/0274509 A1 Sep. 28, 2017

(51) Int. Cl.
*B25B 23/12* (2006.01)
*B25B 23/00* (2006.01)

(52) U.S. Cl.
CPC ..... *B25B 23/12* (2013.01); *B25B 23/0035* (2013.01)

(58) Field of Classification Search
CPC ..... B25B 23/12; B25B 23/0035
USPC ..... 84/451
See application file for complete search history.

(56) References Cited

U.S. PATENT DOCUMENTS 7,195,247 B2 * 3/2007 Shu ..... B25B 23/0035 279/22
2006/0011019 A1 * 1/2006 Chen ..... B25B 13/463 81/63.1
2008/0100005 A1 * 5/2008 Chen ..... B25B 15/001 279/75
2010/0237572 A1 * 9/2010 Casel ..... B23B 31/1072 279/82

* cited by examiner

*Primary Examiner* — Hadi Shakeri

(57) ABSTRACT

A magnetic positioning device for a hand tool includes a body, a sleeve movably mounted to the body, a first clip and a second clip respectively mounted to the body, a resilient member mounted to the body to provide a resilient force to assist the sleeve to be moved to three positions relative to the body. A bead is inserted in a radial hole of the body so as to be engaged with a notch of a bit in the body. A magnetic member is received in one end of the sleeve to attract an object (a bolt) so that the bit can be easily drive the object which does not drop from the sleeve. The object is pushed to be separated from the sleeve by the bit when moving the sleeve to removing position. A magnet is received in the body to position the bit at the body.

4 Claims, 10 Drawing Sheets

A-A

B-B

B-B

B-B

A-A

B-B

B-B

MAGNETIC POSITIONING DEVICE FOR HAND TOOL

BACKGROUND OF THE INVENTION

1. Fields of the Invention

The present invention relates to a magnetic positioning device, and more particularly, to a magnetic positioning device for a hand tool so as to magnetically attract an object to the hand tool.

2. Descriptions of Related Art

The conventional hand tool known to applicant is disclosed in U.S. Pat. No. 4,753,142, and a power-driven screwing head is provided and includes a device for automatically uncoupling the screwing head when a specified depth of penetration of a screw into a workpiece is attained. The head includes a shank adapted to be driven in rotation in either sense having an end portion defined by a wall of annular cross-section defining a seat. A plurality of radial bores are defined through the wall. The shank further includes a member projecting from the shank. A screwdriver bit has two ends, one of which is received in the seat. A sleeve surrounds at least the end portion of said shank, and is movable longitudinally of the shank. The sleeve has an upper and a lower end, wherein the lower end is adapted to be rested on a surface of the workpiece in use for driving in a screw. The sleeve defines an internal surface which includes along its axial length an upper zone, a recessed portion and a lower zone. The recessed portion is of larger diameter than the adjacent zones. A coil spring is arranged between the member on the shank and the upper end of the sleeve. A plurality of locking balls each are received in a respective one of the radial bores in the shank seat. The locking balls are movable radially in the bores so that the balls are held in engagement between the upper zone and the screwing head when the shank is being driven in one sense to drive a screw in, and the balls are held in engagement between the lower zone and the screwing head when the shank is being driven in the opposite sense in order to remove the screw, and the balls move radially out of engagement with the screwing head when the recessed portion of the sleeve is aligned with the bores.

However, when the user uses the blade part of the screwdriver bit to rotate the object, the sleeve does not have a proper device to prevent the blade part from being separated from the object. That is to say, the object may easily drop on the ground. Furthermore, the sleeve has a smooth outer surface which can be slippery when grease attached on the sleeve or the user's hand.

The present invention intends to provide a magnetic positioning device for a hand tool so as to magnetically attract an object to the hand tool, such that the shortcomings mentioned above are eliminated.

SUMMARY OF THE INVENTION

The present invention relates to a magnetic positioning device for a hand tool and comprises a body, a sleeve movably mounted to the body, a first clip and a second clip respectively mounted to the body, a resilient member mounted to the body to provide a resilient force to assist the sleeve to be moved to three positions relative to the body. A bead is inserted in a radial hole of the body so as to be engaged with a notch of a bit in the body. A magnet is received in the body to position the bit at the body. A magnetic member is received in one end of the sleeve to attract an object (a bolt) so that the bit can be easily drive the object which does not drop from the sleeve. The object is pushed to be separated from the sleeve by the bit when moving the sleeve to removing position.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
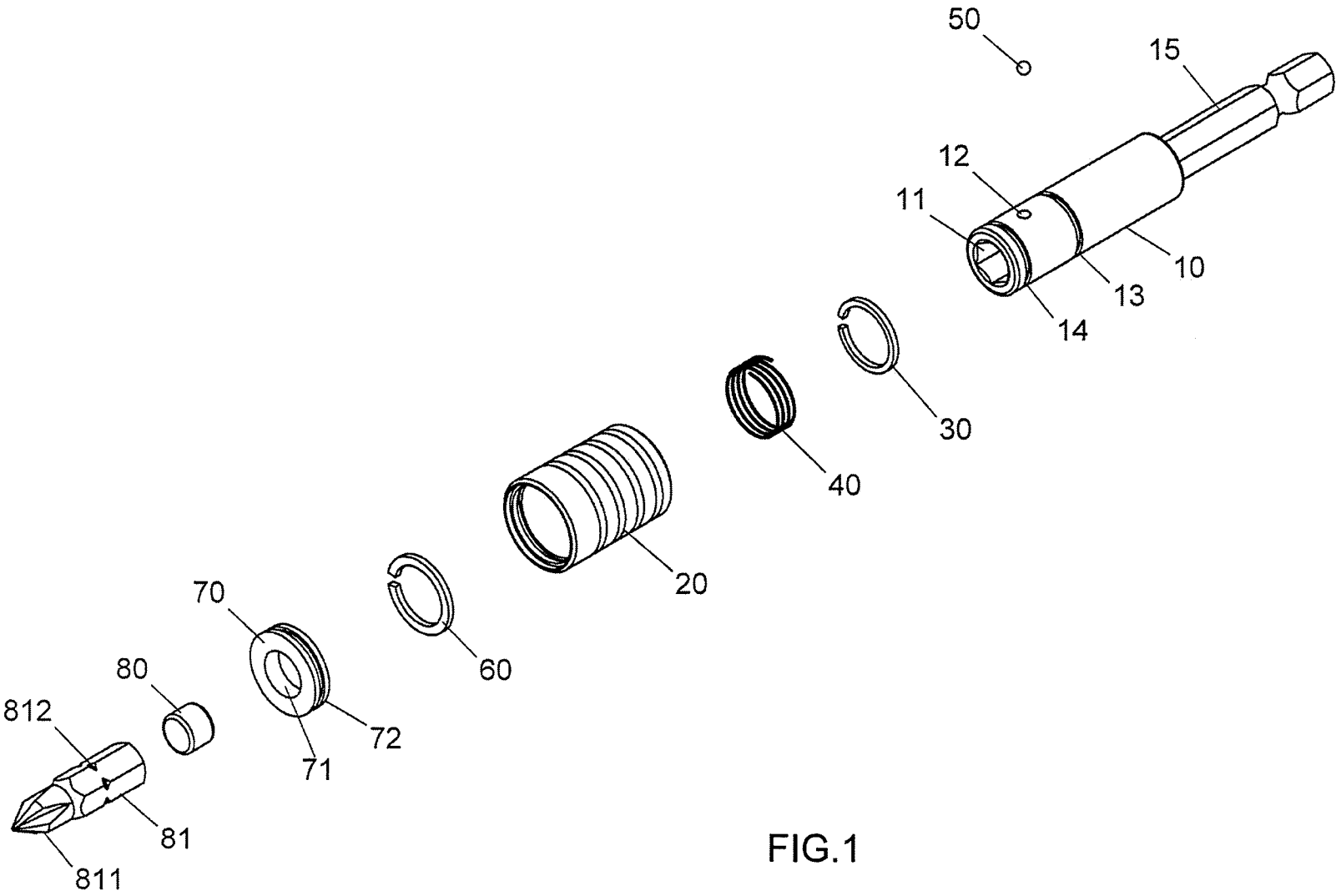
FIG. 1 is an exploded view of the magnetic positioning device for a hand tool of the present invention.
Figure 3:
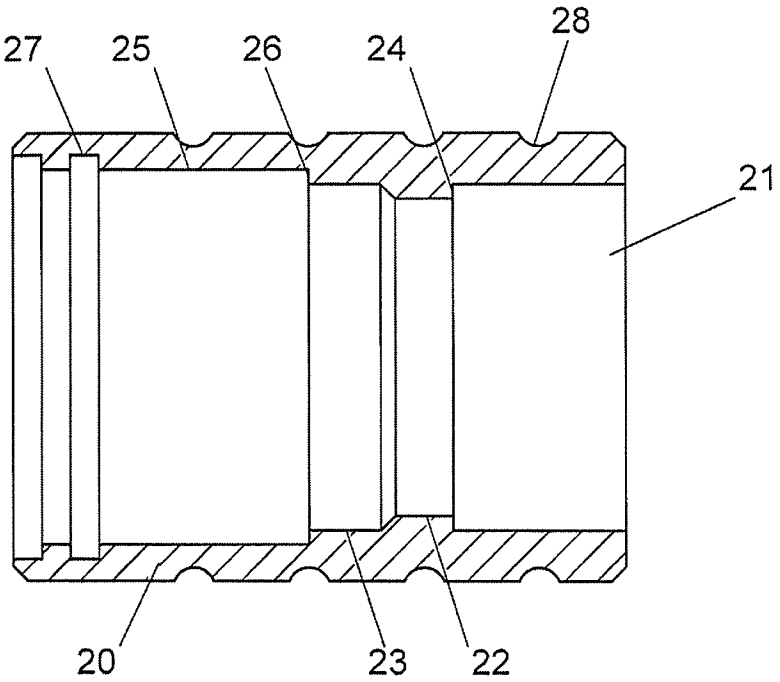
FIG. 3 is a cross sectional view of show the sleeve of the magnetic positioning device for a hand tool of the present invention.
Figure 2:
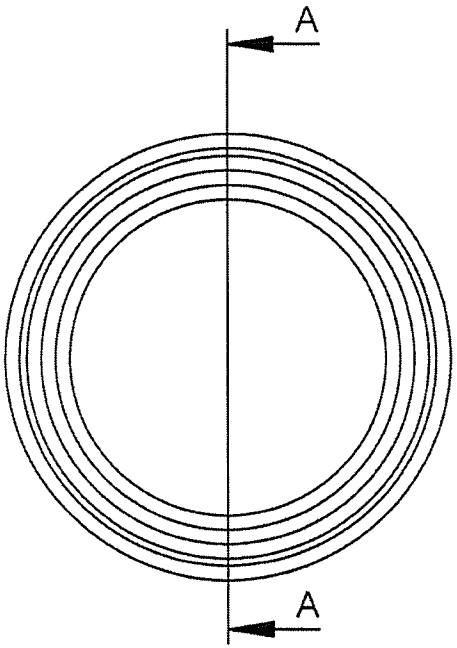
FIG. 2 is an end view of show the sleeve of the magnetic positioning device for a hand tool of the present invention.

Referring to FIGS. 1 to 3, the of the magnetic positioning device for a hand tool of the present invention comprises a body 10, a sleeve 20, a first clip 30, a resilient member 40, a bead 50, a second clip 60, a magnetic member 70, a magnet 80 and a bit 81. The body 10 is a cylindrical body and has a first room 11 defined in the first end thereof, wherein the first room 11 is a hexagonal room. A radial hole 12 is defined through the wall of the body 10 and communicates with the first room 11. The radial hole 12 is located close to the first end of the body 10. A first groove 13 and a second groove 14 are respectively defined in the outer surface of the body 10, and the second groove 14 located close to the first end of the body 10. The radial hole 12 is located between the first and second grooves 13, 14. The second groove 14, the radial hole 12 and the first groove 13 are respectively located in sequence from the first end toward the second end of the body 10. The body 10 has a driving portion 15 which extends from the second end of the body 10 and is a hexagonal portion.

The sleeve 20 is slidably mounted to the body 10 and movable between a locking position, a removing position and a releasing position along the body 10. The sleeve 20 is a cylindrical sleeve and has a first end and a second end, wherein a reception room 21 is defined in the second end of the sleeve 20. A second room 22 is defined in the sleeve 20 and communicates with the reception room 21. The second room 22 is located corresponding to the radial hole 12 of the body 10. The diameter of the second room 22 is smaller than that of the reception room 21 so as to form a first shoulder 24 between the reception room 21 and the second room 22. A third room 23 is defined in the sleeve 20 and communicates with the second room 22 which is located between the third room 23 and the reception room 21. The diameter of the second room 22 is smaller than that of the third room 23. A fourth room 25 is defined in the sleeve 20 and communicates with the third room 23 which is located between the second room 22 and the fourth room 25. The diameter of the fourth room 25 is larger than that of the third room 23 so as to form a second shoulder 26 between the fourth room 25 and the third room 23. An inner groove 27 is defined in the inner periphery of the fourth room 25. The sleeve 20 has an anti-slip surface 28 defined in the outer surface thereof.

The first clip 30 is a C-shaped clip and resilient, and is engaged with the first groove 13. The outer surface of the first clip 30 protrudes beyond the outer surface of the body 10 and is located within the reception room 21 of the sleeve 20.

The resilient member 40 is mounted to the body 10 and located in the reception room 21. Two ends of the resilient member 40 are in contact with the first shoulder 24 and the first clip 30. The resilient member 40 has a recovery force to allow the sleeve 20 to move from the releasing position to the removing position, and to move to the locking position.

The bead 50 is located in the radial hole 12 and pressed by the inner periphery of the second room 22 of the sleeve 20 so as not to drop from the radial hole 12.

The second clip 60 is a C-shaped and resilient clip, and is engaged with the second groove 14. The outer surface of the second clip 60 protrudes beyond the outer surface of the body 10 and is located within the fourth room 25 of the sleeve 20. When the sleeve 20 is biased by the resilient member 40, the second shoulder 26 contacts the second clip 60 to prevent the sleeve 20 from disengaging from the body 10.

The magnetic member 70 is a ring-shaped member and located in the fourth room 25 of the sleeve 20. The magnetic member 70 has a through hole 71 which is located corresponding to the fourth room 25. The magnetic member 70 has a flange 72 which is engaged with the inner groove 27 to fix the magnetic member 70 to the fourth room 25.

The magnet 80 is a cylindrical member and located in the first room 11 of the body 10. The bit 81 is a hexagonal screwdriver bit, and has its rear end detachably received in the first room 11 and is magnetically attracted by the magnet 80. In other words, the bit 81 can be removed from the first room 11. The bit 81 has a function end 811 formed on the front end thereof. The function end 811 is located in the fourth room 25 and extends through the through hole 71 of the magnetic member 70. The function end 811 extends beyond the magnetic member 70. Multiple notches 812 are defined in the outer surface of the bit 80 and located corresponding to the radial hole 12, so that the bead 50 is engaged with one of the notches 812.

Figure 4:
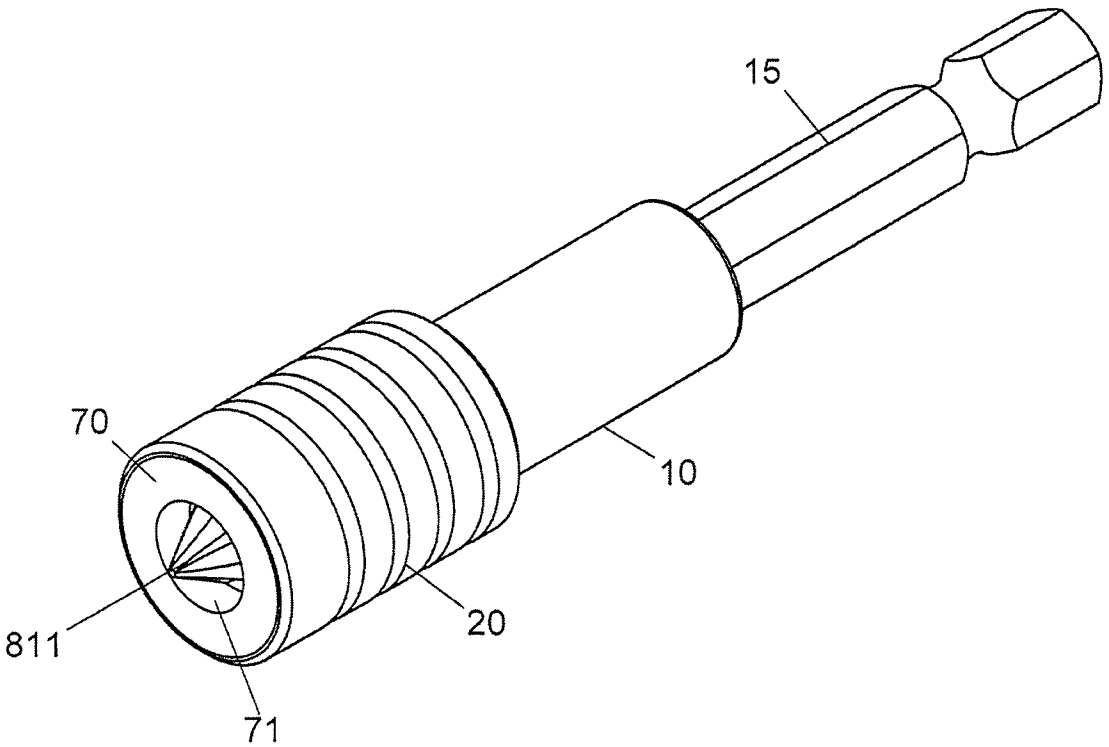
FIG. 4 is a perspective view of the magnetic positioning device for a hand tool of the present invention.

As shown in FIG. 4, the sleeve 20 is movably mounted to the body 10 and has an anti-slip surface 28. The magnetic member 70 is located in the fourth room 25. The bit 81 is received in the first room 11 and extends through the fourth room 25 and the through hole 71 of the magnetic member 70. The function end 811 slightly extends beyond the magnetic member 70.

Figure 5:
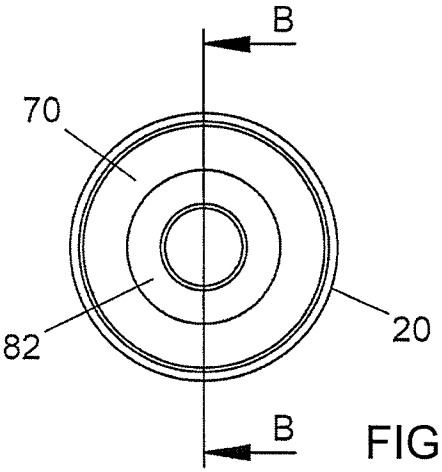
FIG. 5 is an end view to show the magnetic positioning device for a hand tool of the present invention.
Figure 6:
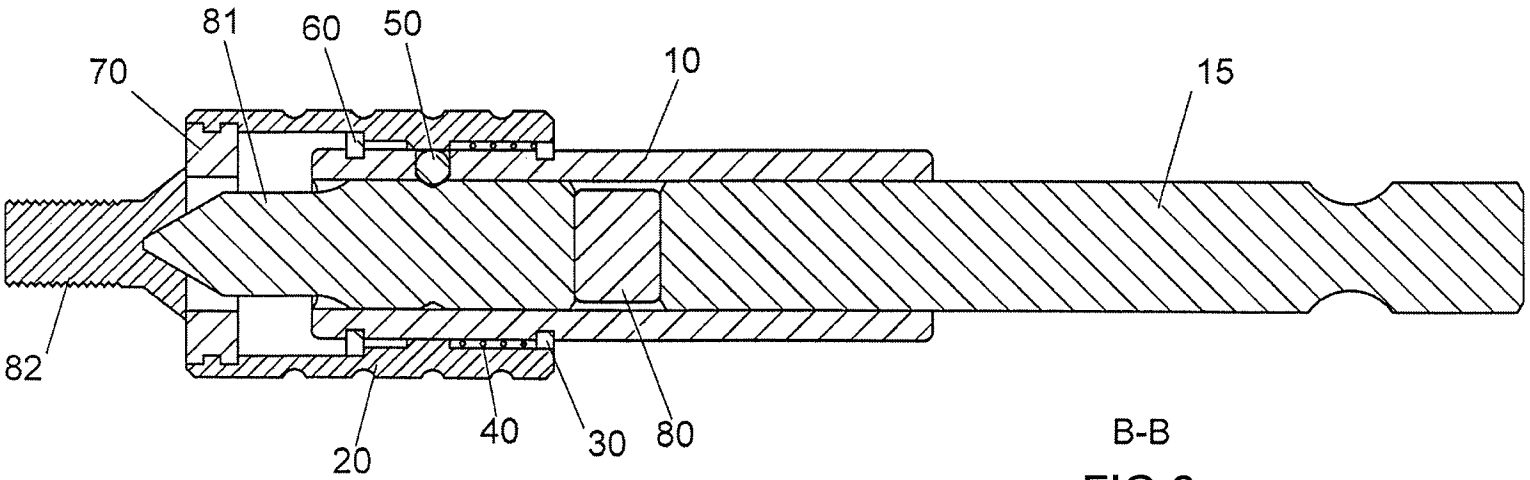
FIG. 6 is a cross sectional view, taken along line B-B in FIG. 5.

As shown in FIGS. 5 and 6, when the user wants to rotate an object 82, a bolt for example, and the sleeve 20 is located at the locking position. The sleeve 20 is biased by the resilient member 40 and the bead 50 in the radial hole 12 contacts the inner periphery of the second room 22 and is engaged with one of the notches 812 of the bit 81. The bit 81 is restricted by the bead 50 and does not disengaged from the first room 11. The second clip contacts the second shoulder 26 of the sleeve 20. The function end 811 of the bit 81 protrudes beyond the magnetic member 70 which magnetically attracts the object 82. The function end 811 does not separate from the object 82.

Figure 7:
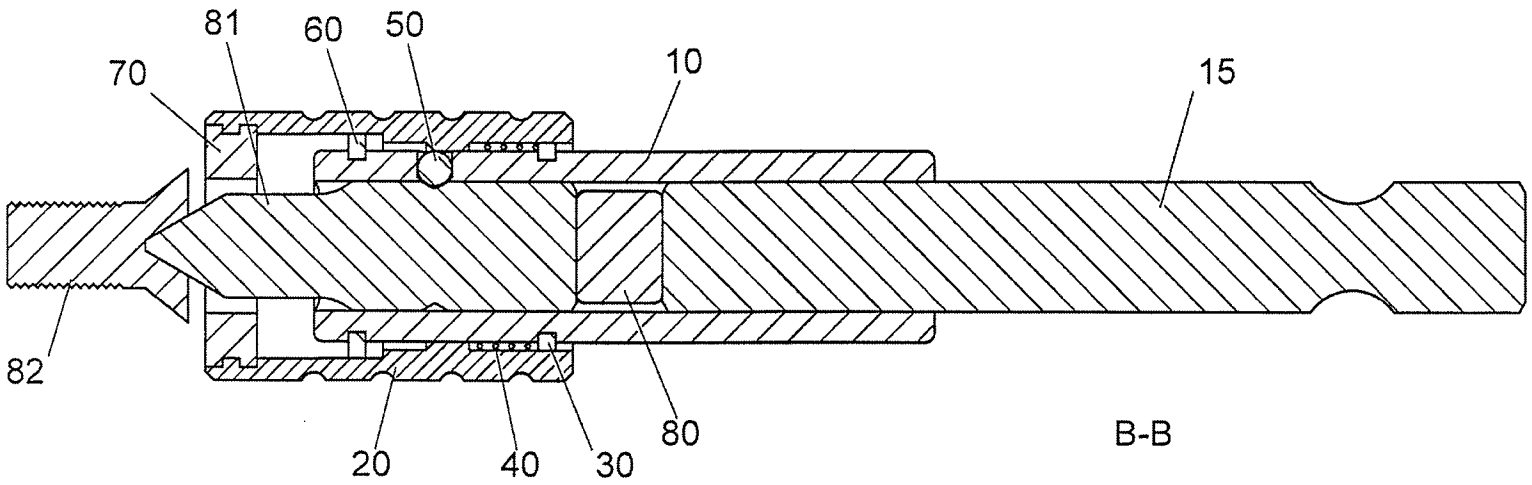
FIG. 7 is a cross sectional view, taken along line B-B in FIG. 5 to show the second operational status of the magnetic positioning device.

As shown in FIG. 7, when removing the object 82, the sleeve 20 moves toward the second end of the body 10 to the removing position. The second clip 60 does not contact the second shoulder 26, and the function end 811 of the bit 81 further protrudes beyond the magnetic member 70. The object 82 is not magnetically attracted by the magnetic member 70, so that the object 82 can be removed from the function end 811 of the bit 81.

Figure 8:
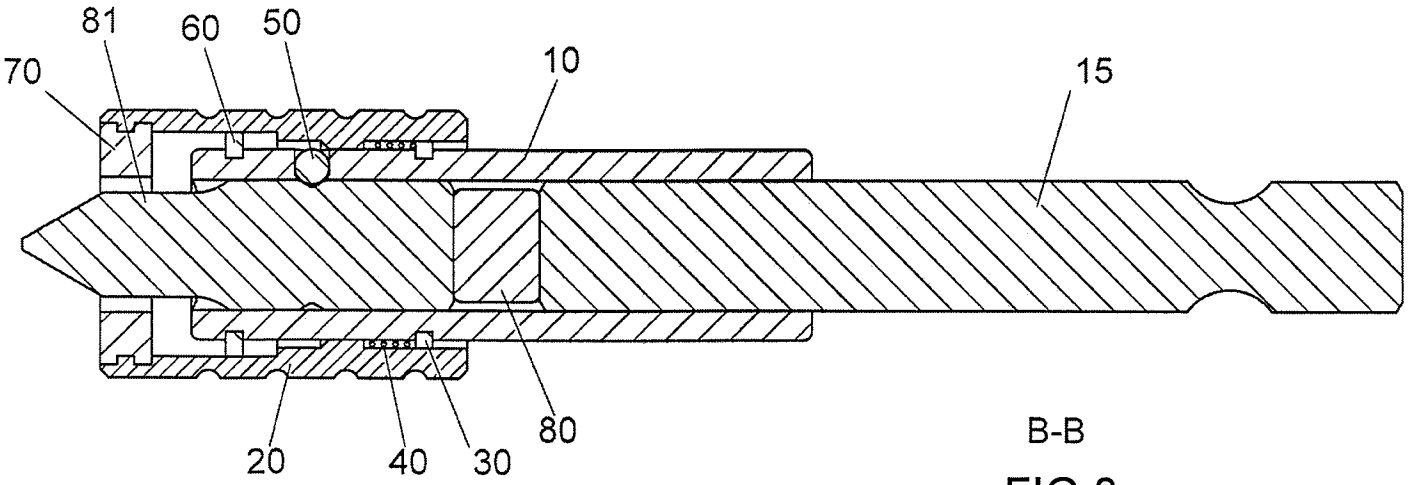
FIG. 8 is a cross sectional view, taken along line B-B in FIG. 5 to show the third operational status of the magnetic positioning device.

As shown in FIG. 8, when the sleeve 20 further moves toward the second end of the body 10 to the releasing position, the function end 811 of the bit 81 even further protrudes beyond the magnetic member 70. The radial hole 12 of the body 10 is located corresponding to the third room 23 of the sleeve 20, and the bead 50 is not in contact with the inner periphery of the third room 23. The bit 81 is pulled to separate the bead 50 from the notch 812, the bit 81 is separated from the first room 11.

Figure 9:
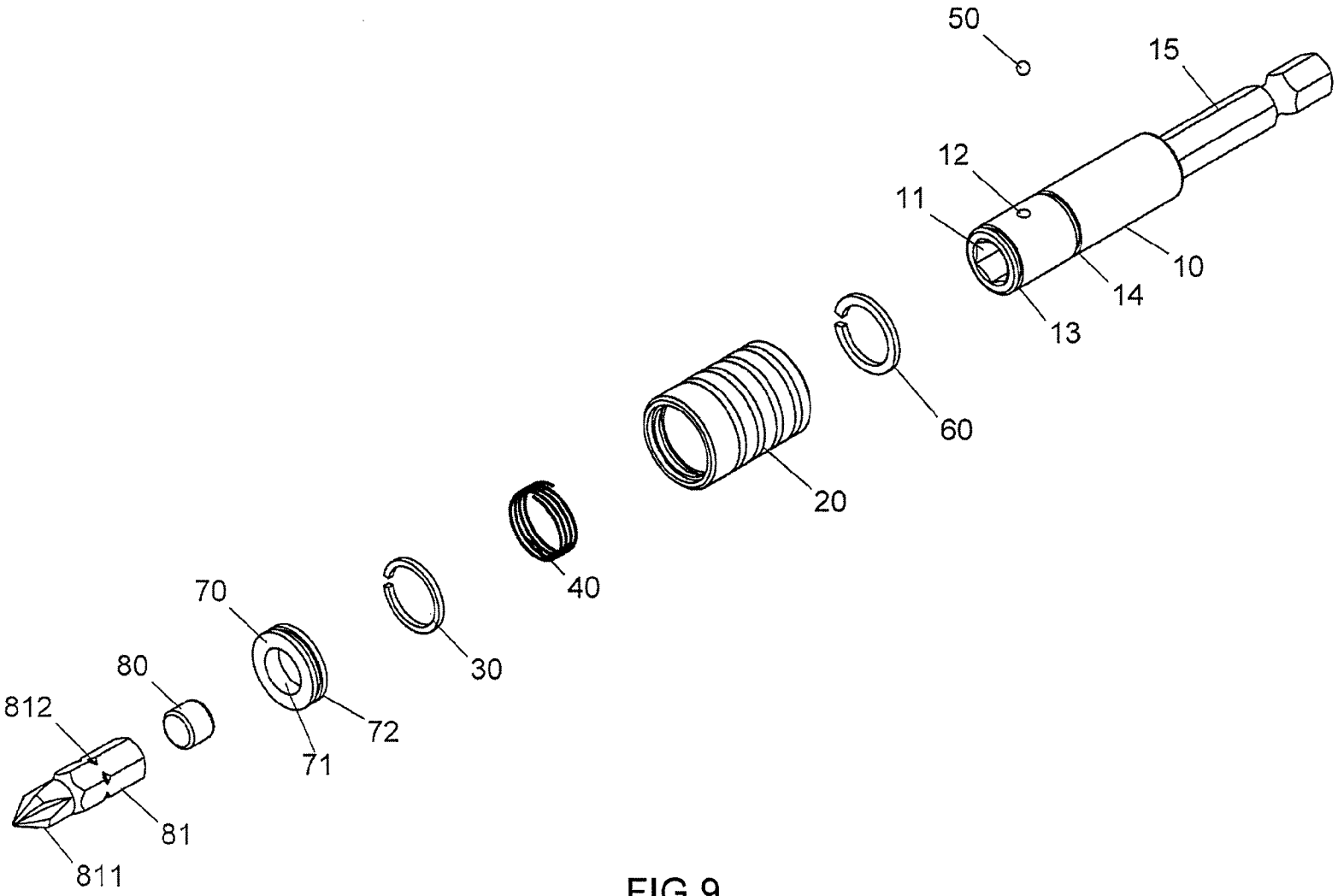
FIG. 9 is an exploded view of the second embodiment of the magnetic positioning device for a hand tool of the present invention.
Figure 11:
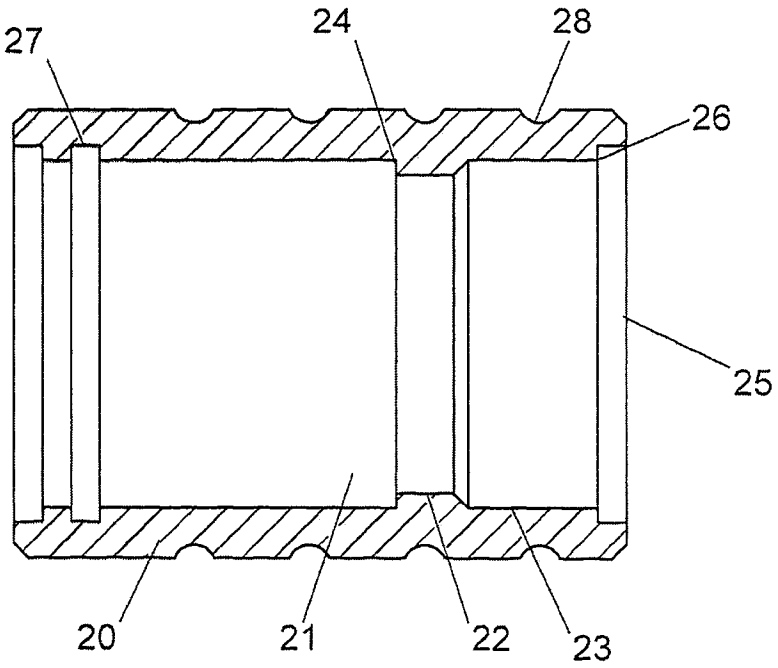
FIG. 11 is a cross sectional view, taken along line A-A in FIG. 10.
Figure 10:
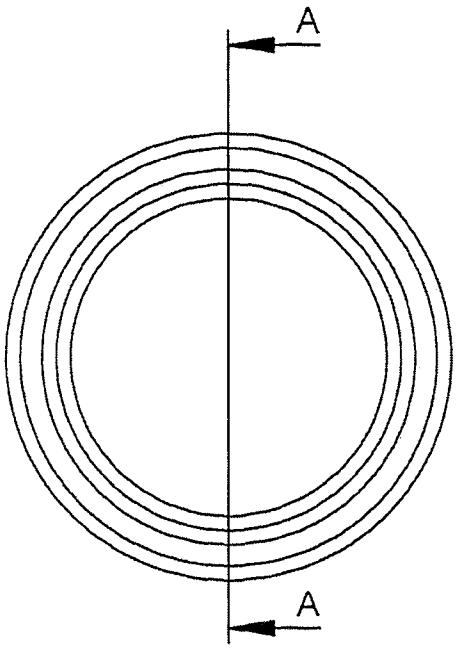
FIG. 10 is an end view of show the second embodiment of the sleeve of the magnetic positioning device for a hand tool of the present invention.

As shown in FIGS. 9 to 11, when compared with the first embodiment, the differences are that the first groove 13 and the second groove 14 are exchanged their positions, and the positions of the first and second clips 30 and 60 are also exchanged. The sleeve 20 is slidably mounted to the body 10 and has a first end and a second end, wherein the reception room 21 is defined in the first end of the sleeve 20. The second room 22 is defined in the sleeve 20 and communicates with the reception room 21. The second room 22 is located corresponding to the radial hole 12 of the body 10. The diameter of the second room 22 is smaller than that of the reception room 21 so as to form a first shoulder 24 between the reception room 21 and the second room 22. A third room 23 is defined in the sleeve 20 and communicates with the second room 22 which is located between the third room 23 and the reception room 21. The diameter of the second room 22 is smaller than that of the third room 23. A fourth room 25 is defined in the sleeve 20 and communicates with the third room 23 which is located between the second room 22 and the fourth room 25. The diameter of the fourth room 25 is larger than that of the third room 23 so as to form a second shoulder 26 between the fourth room 25 and the third room 23. The inner groove 27 is defined in the inner periphery of the fourth room 25. The sleeve 20 has an anti-slip surface 28 defined in the outer surface thereof. That is to say, the arrangement of the rooms 21, 22, 23, 24 and 25 of the sleeve 20 in FIG. 11 is opposite to that of the sleeve 20 in FIG. 3.

Figure 12:
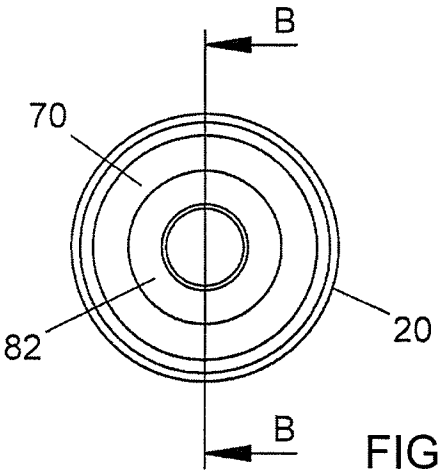
FIG. 12 is an end view of the second embodiment of the magnetic positioning device for a hand tool of the present invention.
Figure 13:
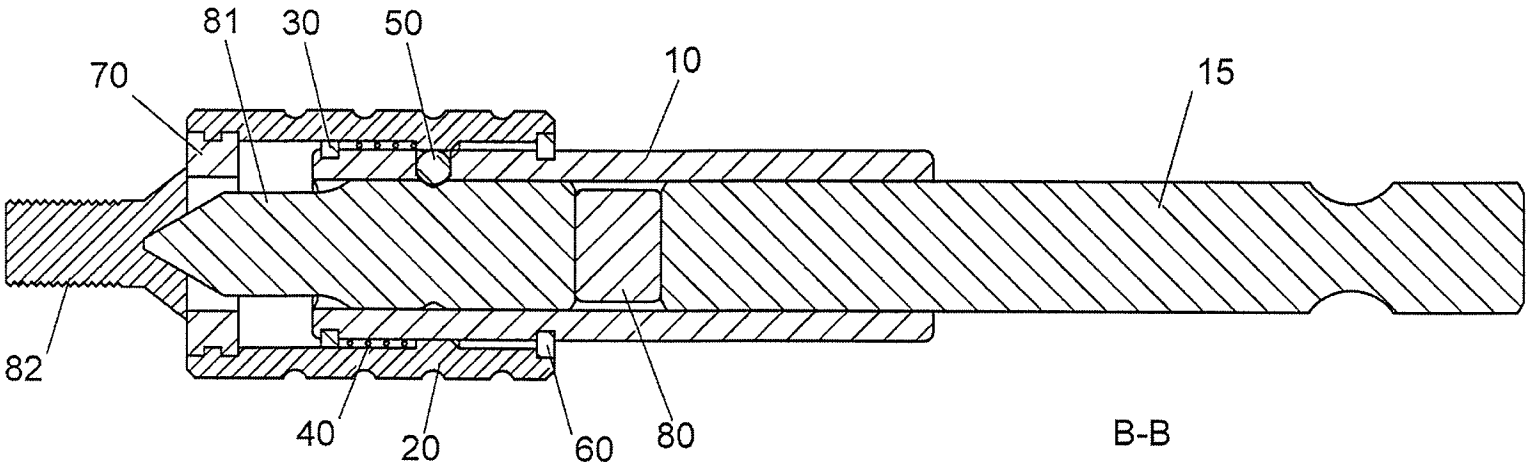
FIG. 13 is a cross sectional view, taken along line B-B in FIG. 12.

As shown in FIGS. 12 and 13, when the user wants to rotate an object 82, the sleeve 20 is biased by the resilient member 40 and the bead 50 in the radial hole 12 contacts the inner periphery of the second room 22 and is engaged with one of the notches 812 of the bit 81. The bit 81 is restricted in the first room 11. The second clip 60 contacts the second shoulder 26 of the sleeve 20. The function end 811 of the bit 81 protrudes beyond the magnetic member 70 which magnetically attracts the object 82. The function end 811 does not separate from the object 82.

Figure 14:
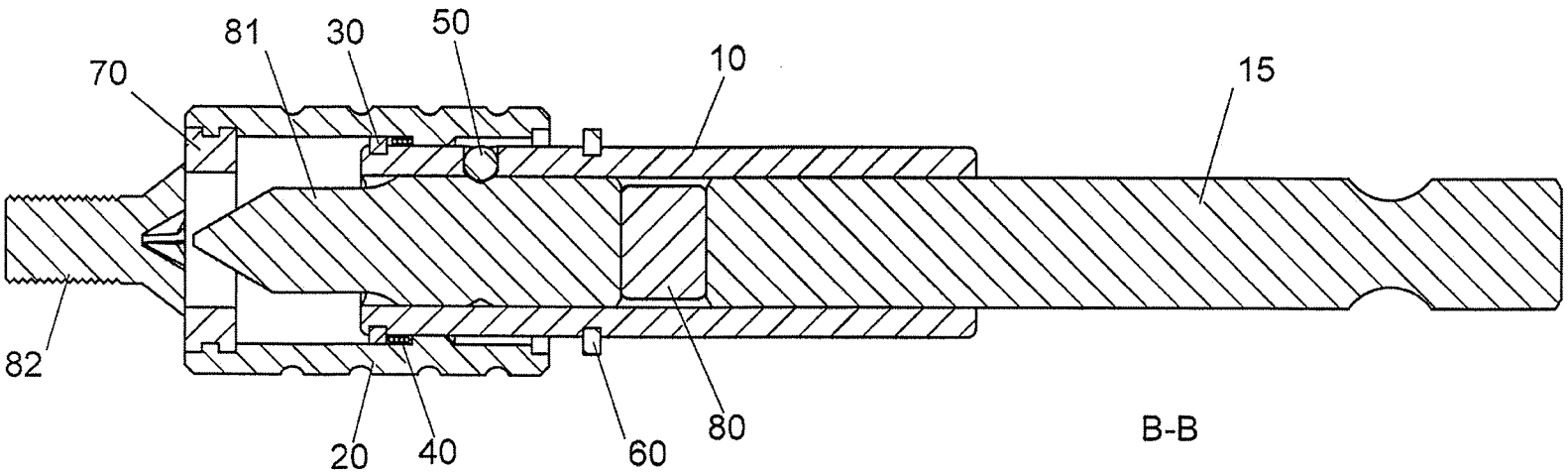
FIG. 14 is a cross sectional view, taken along line B-B in FIG. 12 to show the second operational status of the magnetic positioning device for a hand tool of the present invention.

As shown in FIG. 14, when removing the object 82, the sleeve 20 moves toward the first end of the body 10, the second clip 60 does not contact the second shoulder 26, and the second clip 60 is exposed beyond the body 10 and does not located in the sleeve 20. The function end 811 of the bit 81 is completely hidden in the reception room 21. The object 82 is not engaged with the function end 811, therefore, the object 82 can be removed from the magnetic member 70.

The present invention includes the following advantages which are that when the sleeve 20 is located at the locking position, the function end 811 slightly protrudes beyond the magnetic member 70 which attracts the object 82, so that the function end 811 does not separate from the object 82. The bead 50 restricts the bit 81 from dropping from the first room 11. When the object 82 is engaged with the function end 811, the magnetic member 70 attracts the object 82 so that both the object 82 and the bit 81 are well positioned.

When removing the object 82, the sleeve 20 is moved to the removing position, so that the user can easily remove the object 82 from the function end 811. The sleeve 20 can further be moved to the releasing position, the bit 81 can be pulled out from the first room 11.

The sleeve 20 plays different functions and features when being moved to the locking position, the removing position and the releasing position.

When the sleeve 20 is moved along the body 10 to separate the second clip 60 from the fourth room 25, the user can pick the object 82 from the magnetic member 70. The magnetic member 70 is securely connected to the sleeve 20 by the engagement between the flange 72 of the magnetic member 70 and the inner groove 27 of the sleeve 20. The magnetic member 70 is restricted in the fourth room 25.

The magnet 80 is located in the first room 11 to attract the bit 81, and the bit 81 is positioned by the bead 50 as well, so that the bit 81 does not drop from the first room 11 easily.

While we have shown and described the embodiment in accordance with the present invention, it should be clear to those skilled in the art that further embodiments may be made without departing from the scope of the present invention.

What is claimed is:

1. A magnetic positioning device for a hand tool, comprising:

a body being a cylindrical body and having a first room defined in a first end thereof, the first room being a hexagonal room, a radial hole defined through a wall of the body and communicating with the first room, a first groove and a second groove respectively defined in an outer surface of the body, the second groove located close to the first end of the body, the radial hole located between the first and second grooves;

a sleeve slidably mounted to the body and being movable between a locking position, a removing position and a releasing position along the body, the sleeve being a cylindrical sleeve and having a first end and a second end, a reception room defined in the second end of the sleeve, a second room defined in the sleeve and communicating with the reception room, the second room located corresponding to the radial hole of the body, a diameter of the second room being smaller than that of the reception room so as to form a first shoulder between the reception room and the second room, a third room defined in the sleeve and communicating with the second room which is located between the third room and the reception room, a diameter of the second room being smaller than that of the third room, a fourth room defined in the sleeve and communicating with the third room which is located between the second room and the fourth room, a diameter of the fourth room being larger than that of the third room so as to form a second shoulder between the fourth room and the third room, an inner groove defined in an inner periphery of the fourth room;

a first clip being a C-shaped clip and engaged with the first groove, an outer surface of the first clip protruding beyond the outer surface of the body and located within the reception room of the sleeve;

a resilient member mounted to the body and located in the reception room, two ends of the resilient member being in contact with the first shoulder and the first clip, the resilient member having a recovery force to allow the sleeve to move fi-om the releasing position to the removing position, and to move to the locking position;

a bead located in the radial hole and being pressed by an inner periphery of the second room of the sleeve so as not to drop from the radial hole;

a second clip being a C-shaped clip and engaged with the second groove, an outer surface of the second clip protruding beyond the outer surface of the body and located within the fourth room of the sleeve, when the sleeve is biased by the resilient member, the second shoulder contacts the second clip to prevent the sleeve from disengaging from the body;

a magnetic member located in the fourth room of the sleeve and being a ring-shaped member which has a through hole which is located corresponding to the fourth room, the magnetic member having a flange which is engaged with the inner groove to fix the magnetic member to the fourth room;

a magnet being a cylindrical member and located in the first room of the body;

a bit having a rear end detachably received in the first room and being magnetically attracted by the magnet, the bit having a function end formed on a front end thereof, the function end located in the fourth room and extending through the through hole of the magnetic member, the function end extending beyond the magnetic member, multiple notches defined in an outer surface of the bit and located corresponding to the radial hole, the bead engaged with one of the notches;

wherein when the sleeve is located at the locking position, the sleeve is biased by the resilient member and the bead in the radial hole contacts the inner periphery of the second room and the notch of the bit, the bit is restricted by the bead and does not disengaged from the first room, the second clip contacts the second shoulder of the sleeve, the function end of the bit protrudes beyond the magnetic member which magnetically attracts an object, the function end does not separate from the object;

wherein when the sleeve moves to the removing position, the second clip does not contact the second shoulder, the function end of the bit further protrudes beyond the magnetic member, the object is not magnetically attracted by the magnetic member, the object is separated from the function end of the bit, and wherein when the sleeve moves to the releasing position, the function end of the bit even further protrudes beyond the magnetic member, the radial hole of the body is located corresponding to the third room of the sleeve, the bead is not in contact with an inner periphery of the third room, the bit is pulled to separate the bead from the notch, the bit is separated from the first room.

2. The magnetic positioning device for a hand tool as claimed in claim 1, wherein the body has a driving portion which extends from a second end of the body and is a hexagonal portion.

3. The magnetic positioning device for a hand tool as claimed in claim 1, wherein the sleeve has an anti-slip surface defined in an outer surface thereof.

4. The magnetic positioning device for a hand tool as claimed in claim 1, wherein the bit is a hexagonal screwdriver bit.

* * * * *